US005855247A

United States Patent [19]

Scott et al.

[11] Patent Number: 5,855,247

[45] Date of Patent: Jan. 5, 1999

[54] ROLLING-CUTTER EARTH-BORING BIT HAVING PREDOMINANTLY SUPER-HARD CUTTING ELEMENTS

[75] Inventors: Danny E. Scott, Montgomery, Tex.; Amy J.G. Jurewicz; Stephen R. Jurewicz, both of Los Angeles, Calif.

[73] Assignee: Baker Hughes Incorporated, Houston, Tex.

[21] Appl. No.: 800,419

[22] Filed: Feb. 14, 1997

[51] Int. Cl.[6] ..... E21B 10/46

[52] U.S. Cl. ..... 175/374; 175/428

[58] Field of Search ..... 175/431, 374, 175/430, 432, 434, 428, 420.1

[56] References Cited

U.S. PATENT DOCUMENTS

| | | | |
|---|---|---|---|
| 4,150,728 | 4/1979 | Garner et al. | 175/374 |
| 4,570,726 | 2/1986 | Hall | 175/426 |
| 4,722,405 | 2/1988 | Langford, Jr. | 175/374 |
| 4,832,139 | 5/1989 | Minikus et al. | 175/374 |
| 5,323,865 | 6/1994 | Isbell et al. | 175/378 |
| 5,346,026 | 9/1994 | Pessier et al. | 175/331 |
| 5,353,885 | 10/1994 | Hooper et al. | 175/378 |
| 5,592,995 | 1/1997 | Scott et al. | 175/431 X |
| 5,752,573 | 5/1998 | Scott et al. . | |
| 5,758,733 | 6/1998 | Scott et al. . | |

FOREIGN PATENT DOCUMENTS 2309242 7/1997 United Kingdom .

*Primary Examiner*—Frank S. Tsay
*Attorney, Agent, or Firm*—James E. Bradley

[57] ABSTRACT

An earth-boring bit has a bit body. At least one cantilevered bearing shaft depends inwardly and downwardly from the bit body and a cutter is mounted for rotation on the bearing shaft. The cutter includes a plurality of cutting elements, at least one of which has a generally cylindrical element body of hard metal. A pair of flanks extend from the body and converge to define a crest. The crest defines at least one sharp cutting edge at its intersection with one of the flanks.

16 Claims, 2 Drawing Sheets

ROLLING-CUTTER EARTH-BORING BIT HAVING PREDOMINANTLY SUPER-HARD CUTTING ELEMENTS

BACKGROUND OF THE INVENTION

1. Field of the Invention

The present invention relates to earth-boring bits of the rolling cutter variety. Specifically, the present invention relates to the cutting structure and cutting elements of earth-boring bits of the rolling cutter variety.

2. Background Information

The success of rotary drilling enabled the discovery of deep oil and gas reserves. The rotary rock bit was an important invention that made that success possible. Only soft formations could be commercially penetrated with the earlier drag bit, but the original rolling-cone rock bit invented by Howard R. Hughes, U.S. Pat. No. 939,759, drilled the hard caprock at the Spindletop field, near Beaumont Texas, with relative ease.

That venerable invention, within the first decade of this century, could drill a scant fraction of the depth and speed of the modern rotary rock bit. If the original Hughes bit drilled for hours, the modern bit drills for days. Bits today often drill for miles. Many individual improvements have contributed to the impressive overall improvement in the performance of rock bits.

Rolling-cutter earth-boring bits generally employ cutting elements to induce high contact stresses in the formation being drilled as the cutters roll over the bottom of the borehole during drilling operation. These stresses cause the rock to fail, resulting in disintegration through near-vertical penetration of the formation material being drilled. When cutters are offset, their axes do not coincide with the geometric or rotational axis of the bit and a small component of horizontal or sliding motion is imparted to the cutters as they roll over the borehole bottom. While this drilling mode prevails on the borehole bottom, it is entirely different in the corner and on the sidewall. The corner is generated by a combined crushing and scraping or shearing action, while the borehole wall is produced in a pure sliding and scraping (shearing) mode. In the corner and on the sidewall of the borehole, the cutting elements have to do the most work and are subjected to extreme stresses, which makes them prone to break down prematurely, and/or wear rapidly.

Recently, there has been a general effort to introduce the improved material properties of natural and synthetic diamond or super-hard materials into earth-boring bits of the rolling-cutter variety. Super-hard materials have been used in fixed-cutter or drag bits to good effect for many years. Fixed-cutter bits employ the shearing mode of disintegration discussed above almost exclusively. Although diamond and other super-hard materials possess excellent hardness and other material properties, they generally are considered too brittle for most cutting element applications in rolling-cutter bits, an exception being the shear-cutting gage inserts discussed above.

Recent attempts to introduce diamond and similar materials into rolling cutter bits have relied on a diamond layer or table secured to a substrate or backing material of fracture-tough hard metal, usually cemented tungsten carbide. The substrate is thought to supplement the diamond or super-hard material with its increased toughness, resulting in a cutting element with satisfactory hardness and toughness, which diamond alone is not thought to provide.

One problem with the diamond/substrate inserts is the tendency of the diamond or super-hard material to delaminate from the substrate. The cause of this delamination is thought to be forces acting parallel to the interface between the diamond layer or table and the substrate superimposed on the high residual stresses at this interface. These stresses shear the diamond table off of its substrate.

Several attempts have been made to increase the strength of the interface. U.S. Pat. No. 4,604,106, to Hall et al. discloses a transition layer interface that gradually transitions between the properties of the super-hard material and the substrate material at the interface between them to resist delamination. Although this method appears to yield satisfactory results, it requires expensive and time-consuming fabrication techniques. Other patents, such as commonly assigned U.S. Pat. No. 5,351,772, Oct. 4, 1994 to Smith, provide a non-planar interface between the diamond table and substrate. U.S. Pat. No. 5,355,969 to Hardy et al. is another example of the non-planar interface between the super-hard and substrate.

At any rate, most attempts to incorporate diamond or other super-hard materials into the cutting structures of earth-boring bits of the rolling-cutter variety employ a non-diamond substrate material in addition to the super-hard material.

A need exists, therefore, for earth-boring bits of the rolling-cutter variety having super-hard cutting elements that are relatively easily manufactured with a satisfactory combination of material properties.

SUMMARY OF THE INVENTION

It is a general object of the present invention to provide an earth-boring bit having super-hard cutting elements with satisfactory material properties.

These and other objects of the present invention are achieved by providing an earth-boring bit having a bit body and at least one bearing shaft depending inwardly and downwardly from the bit body. A cutter is mounted for rotation on each bearing shaft and includes a plurality of cutting elements arranged in circumferential rows. The circumferential rows include a gage row on the outermost surface of each cutter and several inner rows on each cutter inward of the gage row. At least one of the cutting elements in one circumferential row is formed fully or predominantly of super-hard material. The cutting element comprises a cutting end projecting from the surface of the cutter and generally cylindrical base secured in a socket in the cutter. The cutting end of the cutting element is formed entirely or predominantly of super-hard material and the base may be formed entirely or predominantly of super-hard material. According to the preferred embodiment of the present invention, the super-hard cutting element may be a heel or inner-row element secured to the cutter end and inner circumferential row.

According to the preferred embodiment of the present invention, the super-hard cutting element may be a gage-row element secured to the cutter in the gage row.

According to the preferred embodiment of the present invention, the super-hard trimmer cutting element has a chisel-shaped cutting end.

According to the preferred embodiment of the present invention, the super-hard gage-row, cutting element has a frusto-conical cutting end.

According to the preferred embodiment of the present invention, the super-hard material is selected from the group consisting of polycrystalline diamond, thermally stable polycrystalline diamond, natural diamond, and cubic boron nitride.

DESCRIPTION OF THE PREFERRED EMBODIMENT

Figure 1:
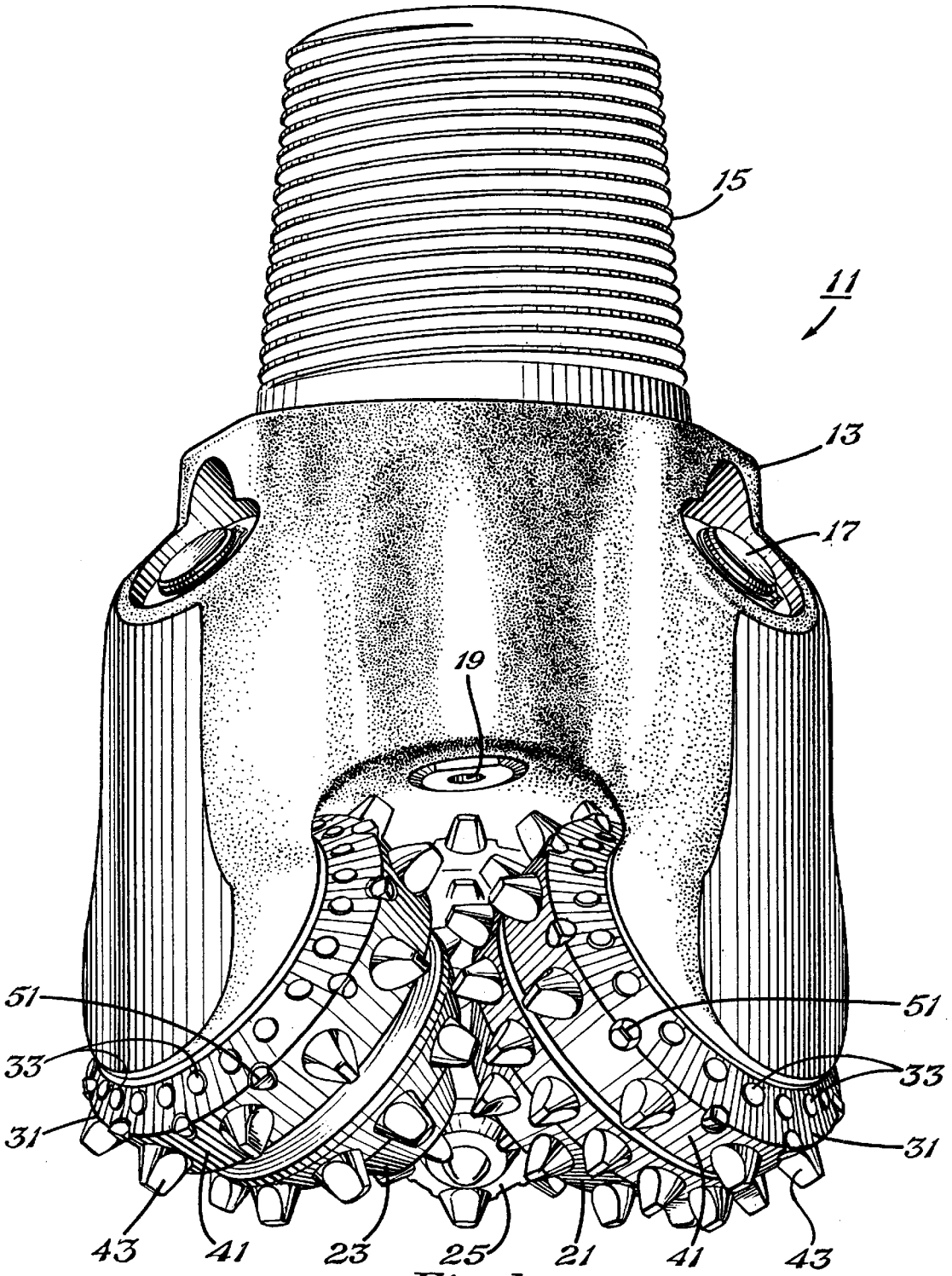
FIG. 1 is a perspective view of an earth-boring bit according to the present invention.

Referring now to the figures, and particularly to FIG. 1, an earth-boring bit 11 according to the present invention is illustrated. Bit 11 includes a bit body 13, which is threaded at its upper extent 15 for connection into a drillstring. Each leg or section of bit 11 is provided with a lubricant compensator 17 to adjust or compensate for changes in the pressure or volume of lubricant provided for the bit. At least one nozzle 19 is provided in bit body 13 to spray drilling fluid from within the drillstring to cool and lubricate bit 11 during drilling operation. Three cutters, 21, 23, 25 are rotatably secured to a bearing shaft associated with each leg of bit body 13. Each cutter 21, 23, 25 has a cutter shell surface including an outermost or gage surface 31 and a heel surface 41 immediately inward and adjacent gage surface 31.

A plurality of cutting elements, in the form of hard metal or super-hard inserts, are arranged in generally circumferential rows on each cutter. Each cutter 21, 23, 25 has a gage surface 31 with a row of gage elements 33 thereon. A heel surface 41 intersects each gage surface 31 and has at least one row of heel inserts 43 thereon. At least one scraper element 51 is secured to the cutter shell surface generally at the intersection of gage and heel surfaces 31, 41 and generally intermediate a pair of heel inserts 43.

The outer cutting structure, comprising heel cutting elements 43, gage cutting elements 33, and a secondary cutting structure in the form of chisel-shaped trimmer or scraper elements 51, combine and cooperate to crush and scrape formation material at the corner and sidewall of the borehole as cutters 21, 23, 25 roll and slide over the formation material during drilling operation. According to the preferred embodiment of the present invention, at least one, and preferably several, of the cutting elements in one or more of the rows is formed predominantly of super-hard material.

Figure 2:
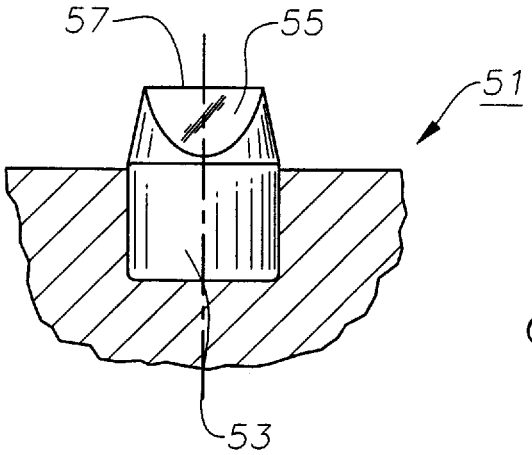
FIG. 2 is an elevation view of a super-hard cutting element for the heel or inner rows of an earth-boring bit according to the present invention.

FIG. 2 is an elevation view, partially in section, of a super-hard cutting element 51 according to the present invention. Cutting element 51 comprises a generally cylindrical base 53, which is secured in an aperture or socket in the cutter by interference fit or brazing. Cutting element 51 is a chisel-shaped cutting element that includes a pair of flanks 55 that converge to define a crest 57. Chisel-shaped cutting element is particularly adapted for use as a trimmer element (51 in FIG. 1), a heel element (41 in FIG. 1) or other inner-row cutting element. A chisel-shaped element is illustrated as an exemplary trimmer, heel, or inner-row cutting element. Other conventional shapes, such as ovoids, cones, or rounds are contemplated by the present invention.

Figure 3:
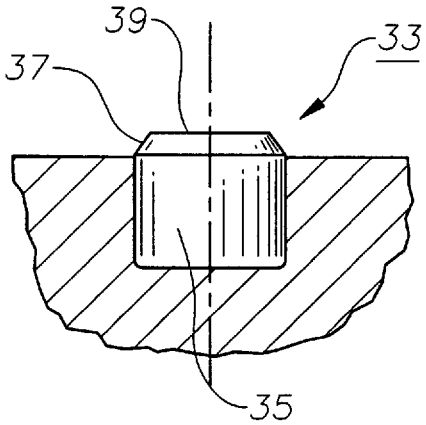
FIG. 3 is an elevation view of a super-hard cutting element for the gage rows of an earth-boring bit according to the present invention.

FIG. 3 is an elevation view, partially in section, of a super-hard gage-row insert 33 according to the present invention. Gage-row insert 33 comprises a generally cylindrical body 35, which is provided at the cutting end with a chamfer 37 that defines a generally frusto-conical cutting surface. The intersection between cutting surface 37 and flat top 39 defines a cutting edge for shearing engagement with the sidewall of the borehole.

Both chisel-shaped element 51 and gage insert 33 are formed predominantly of super-hard material. The term "super-hard material," as used herein, includes natural diamond, polycrystalline diamond, thermally stable polycrystalline diamond, cubic boron nitride, the material resulting from chemical vapor deposition (CVD) processes known as "thin-film diamond," or "amorphic diamond," and other materials approaching diamond in hardness and having material properties generally similar to diamond. All super-hard materials have measured hardness in excess of 3500–5000 on the Knoop scale and are to be distinguished from merely hard ceramics, such as silicon carbide, tungsten carbide, and the like.

The predominantly super-hard material insert is usually formed at high pressure and temperature conditions under which the super-hard material is thermodynamically stable. This technique is conventional and known by those skilled in the art. For example, a insert may be made by forming a refractory metal container or can to the desired shape, and then filling the can with super-hard material powder to which a small amount of metal material (commonly cobalt, nickel, or iron) has been added. The container then is sealed to prevent any contamination. Next, the sealed can is surrounded by a pressure transmitting material which is generally salt, boron nitride, graphite or similar material. This assembly is then loaded into a high-pressure and temperature cell. The design of the cell is dependent upon the type of high-pressure apparatus being used. The cell is compressed until the desired pressure is reached and then heat is supplied via a graphite-tube electric resistance heater. Temperatures in excess of 1350° C. and pressures in excess of 50 kilobars are common. At these conditions, the added metal is molten and acts as a reactive liquid phase to enhance sintering of the super-hard material. After a few minutes, the conditions are reduced to room temperature and pressure. The insert is then broken out of the cell and can be finished to final dimensions through grinding or shaping.

According to the preferred embodiment of the present invention, at least the cutting ends of elements 51, 31 are formed entirely of super-hard material. All super-hard materials contain at least traces of other materials. For instance, polycrystalline diamond employs cobalt as a binder during its formation process and cobalt remains in the material. As used herein, the term "entirely of" super-hard material is intended to include these traces of material other than super-hard material. The term "predominantly of" super-hard material is intended to exclude layers of super-hard material over substrates that comprise most of the volume of the element.

It may be desirable to provide a cutting element formed entirely of super-hard material with a portion of the element formed of a less wear-resistant and more easily formed material. For example, a 0.063 inch layer of conventional cemented tungsten carbide may be provided on the base of the cylindrical body of the element (opposite the cutting end) to protect the super-hard material while the element is press or interference fit into its aperture or socket in the cutter. Such a layer of hard metal may also be provided where a portion of the element requires tumbling, grinding, or other finishing operations. Such a layer of non-super-hard material is encompassed within the meaning of "predominantly super-hard material." Such a layer of non-super-hard material should constitute not more than about 10–20% by volume of the cutting element.

The earth-boring bit according to the present invention possesses a number of advantages. A primary advantage is that the earth-boring bit is provided with more efficient and durable cutting elements.

The invention has been described with reference to preferred embodiments thereof. It is thus not limited, but is susceptible to variation and modification without departing from the scope and spirit of the invention.

We claim:

1. An earth-boring bit comprising:

a bit body;

at least one bearing shaft depending inwardly and downwardly from the bit body;

a cutter mounted for rotation on the bearing shaft, the cutter including a plurality of cutting elements arranged on the cutter in circumferential rows;

at least one of the cutting elements in one of the rows being a super-hard cutting element having a cutting end protecting from the cutter and a generally cylindrical base secured in an aperture formed in the cutter, the super-hard cutting element being formed with at least 80 percent of the material of the super-hard cutting element being a super-hard material; and the cutting end of the super-hard cutting element being formed entirely of the super-hard material.

2. The earth-boring bit according to claim 1 wherein the rows of cutting elements on the cutter comprise an outer circumferential row and at least one inner circumferential row, the inner circumferential row being located closer to an axis of rotation of the bit body than the outer circumferential row, and wherein the super-hard cutting element is secured to the cutter in the inner circumferential row.

3. The earth-boring bit according to claim 1 wherein the super-hard cutting element is a gage-row element secured to the cutter in a circumferential row on a gage surface of the cutter.

4. The earth-boring bit according to claim 1 wherein the super-hard cutting element has a chisel-shaped cutting end.

5. The earth-boring bit according to claim 1 wherein the super-hard material is selected from the group consisting of polycrystalline diamond, thermally stable polycrystalline diamond, natural diamond, and cubic boron nitride.

6. The earth-boring bit according to claim 1 wherein any of the material of the super-hard cutting element other than the super-hard material is located within the base.

7. An earth-boring bit comprising:

a bit body;

at least one bearing shaft depending inwardly and downwardly from the bit body;

a cutter mounted for rotation on the bearing shaft, the cutter including a plurality of cutting elements arranged on the cutter in circumferential rows;

at least one of the cutting elements in one of the rows being formed at least predominantly of super-hard material; wherein the super-hard cutting element has a cutting end projecting from the cutter and a generally cylindrical base secured in an aperture in the cutter; and wherein the cutting end of the super-hard cutting element is formed entirely of super-hard material and the base is formed at least predominantly of super-hard material.

8. The earth-boring bit according to claim 7 wherein the rows of cutting elements on the cutter comprise an outer circumferential row and at least one inner circumferential row, the inner circumferential row being located closer to an axis of rotation of the bit body than the outer circumferential row, and wherein the super-hard cutting element is secured to the cutter in the inner circumferential row.

9. The earth-boring bit according to claim 7 wherein the super-hard cutting element is a gage-row element secured to the cutter in a circumferential row on a gage surface of the cutter.

10. The earth-boring bit according to claim 7 wherein the super-hard cutting element has a chisel-shaped cutting end.

11. The earth-boring bit according to claim 7 wherein the super-hard material is selected from the group consisting of polycrystalline diamond, thermally stable polycrystalline diamond, natural diamond, and cubic boron nitride.

12. An earth-boring bit comprising:

a bit body;

at least one bearing shaft depending inwardly and downwardly from the bit body;

a cutter mounted for rotation on the bearing shaft, the cutter including a plurality of cutting elements arranged on the cutter in circumferential rows, the circumferential rows including a gage row proximal the outermost surface of the cutter;

at least one of the cutting elements in the gage row being formed at least predominantly of super-hard material; wherein the super-hard cutting element has a frustoconical cutting end projecting from the cutter and a generally cylindrical base secured in an aperture in the cutter; and the cutting end of the super-hard cutting element is formed entirely of super-hard material and the base is formed at least predominantly of super-hard material.

13. The earth-boring bit according to claim 12 wherein the super-hard material is selected from the group consisting of polycrystalline diamond, thermally stable polycrystalline diamond, natural diamond, and cubic boron nitride.

14. An earth-boring bit comprising:

a bit body having an axis of rotation;

at least one bearing shaft depending inwardly and downwardly from the bit body;

a cutter mounted for rotation on the bearing shaft, the cutter including a plurality of cutting elements arranged on the cutter in circumferential rows, the circumferential rows including an outer row and a plurality of inner rows, the inner rows being located closer to the axis than the outer row;and at least one of the cutting elements in one of the inner rows being formed at least predominantly of super-hard material; wherein the super-hard cutting element has a cutting end projecting from the cutter and a generally cylindrical base secured in a socket in the cutter; and the cutting end of the super-hard cutting element is formed entirely of super-hard material and the base is formed at least predominantly of super-hard material.

15. The earth-boring bit according to claim 14 wherein the super-hard cutting element has a chisel-shaped cutting end.

16. The earth-boring bit according to claim 14 wherein the super-hard material is selected from the group consisting of polycrystalline diamond, thermally stable polycrystalline diamond, natural diamond, and cubic boron nitride.

* * * * *